United States Patent [19]

Oguri

[11] Patent Number: 4,706,537

[45] Date of Patent: Nov. 17, 1987

[54] TONE SIGNAL GENERATION DEVICE

[75] Inventor: Shigenori Oguri, Hamamatsu, Japan

[73] Assignee: Nippon Gakki Seizo Kabushiki Kaisha, Shizuoka, Japan

[21] Appl. No.: 836,247

[22] Filed: Mar. 5, 1986

[30] Foreign Application Priority Data

Mar. 7, 1985 [JP] Japan ..... 60-45508
Mar. 7, 1985 [JP] Japan ..... 60-45509
Mar. 7, 1985 [JP] Japan ..... 60-45510

[51] Int. Cl.[4] ..... G10H 1/02; G10H 1/42; G10H 7/00

[52] U.S. Cl. ..... 84/1.03; 84/1.1; 84/1.19; 84/1.26

[58] Field of Search ..... 84/1.1–1.13, 84/1.19–1.27, 1.03, DIG. 12

[56] References Cited

U.S. PATENT DOCUMENTS

| | | | |
|---|---|---|---|
| 4,383,462 | 5/1983 | Nagai | 84/1.26 |
| 4,442,745 | 4/1984 | Gross et al. | 84/1.26 X |
| 4,502,361 | 3/1985 | Viitanen et al. | 84/1.26 |
| 4,520,708 | 6/1985 | Wachi | 84/1.26 |
| 4,524,666 | 6/1985 | Kato | 84/1.26 X |
| 4,573,389 | 3/1986 | Suzuki | 84/1.26 |
| 4,635,520 | 1/1987 | Mitsumi | 84/1.26 |
| 4,638,710 | 1/1987 | Kitamura et al. | 84/1.26 |

FOREIGN PATENT DOCUMENTS 55398 3/1985 Japan .

*Primary Examiner*—S. J. Witkowski
*Attorney, Agent, or Firm*—Spensley Horn Jubas & Lubitz

[57] ABSTRACT

Waveshapes of plural periods for plural channels having characteristics different from each other are stored in a waveshape memory and read out from it when a musical tone is to be produced. Read out waveshapes are respectively weighted by weighting data supplied from a weighting data generator and thereafter a desired tone waveshape is obtained by electrically or acoustically combining these weighted waveshape. As an example, the waveshapes are composed of plural attack waveshapes equal in number to channels and only one sustain waveshape. In this case, the attack portion of the musical tone is formed by the combined one of the attack waveshapes and the sustain portion is formed by the sustain waveshape. This enables the memory capacity of the waveshape memory to be reduced and facilitates the complex tone color control in the attack portion. In another case, each of the waveshapes is composed of an attack portion and a sustain portion, sustain waveshapes forming the sustain portions being matched in phase. In both of the above cases, weighting data may be different depending upon a tone color to be imparted on the musical tone.

20 Claims, 16 Drawing Figures

WAVESHAPE OF AN ACTUAL PIANO SOUND (ORIGINAL WAVESHAPE) PLAYED WITH A STRONG TOUCH

WAVESHAPE OF AN ACTUAL PIANO SOUND (ORIGINAL WAVESHAPE) PLAYED WITH A WEAK TOUCH

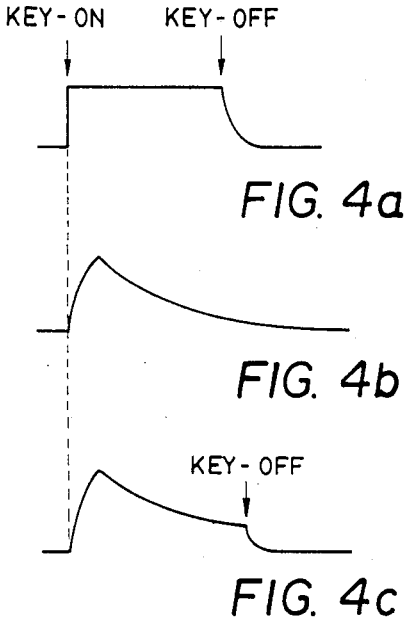
FIG. 4a
FIG. 4b
FIG. 4c
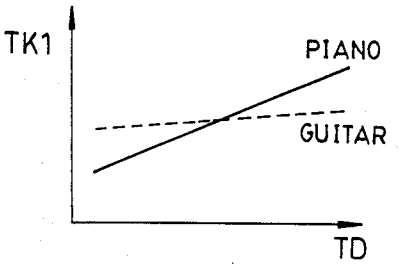
FIG. 5a
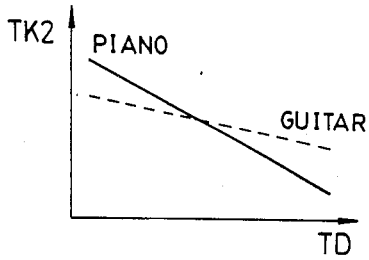
FIG. 5b
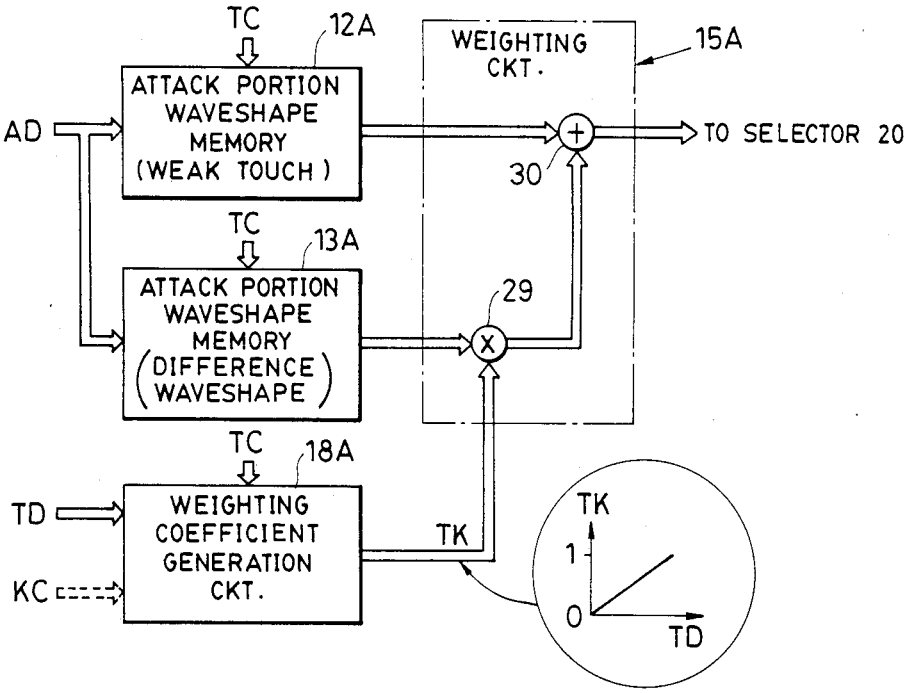
FIG. 6

TONE SIGNAL GENERATION DEVICE

BACKGROUND OF THE INVENTION

This invention relates to a tone signal generation device capable of generating a tone signal having a tone color controlled in accordance with key touch or other tone color control factors and, more particularly, to a tone signal generation device generating a tone signal by properly weighting waveshape signals of plural channels having different characteristics and combining these weighted waveshape signals. The invention relates also to a tone signal generation device capable of changing functions used for weighting in accordance with a selected tone color.

In order to generate a tone waveshape signal of a high quality, it has recently been practiced to store either a full waveshape from the start of sounding of a tone to the end thereof or a full waveshape of an attack portion and a part of the subsequent waveshape and read out the full waveshape once when the full waveshape has been stored or read out the waveshape of the attack portion once and then the part of the subsequent waveshape repeatedly (U.S. Pat. No. 4,383,462). This system according to which a continuous waveshape of multiple periods is stored in a waveshape memory requires a memory of an extremely large memory capacity while it can produce a tone waveshape signal of a high quality and, for this reason, it is unsuitable for realizing various tone color changes according to the key touch, tone pitch or other tone color control factors. For effecting a key scaling control in which the tone color is changed in accordance with the tone pitch or tone range of a tone to be produced, or a touch response control in which the tone color is changed in accordance with a state of operation (speed or strength of operation) of a playing key, or an operation knob control in which the tone color is changed in accordance with a state of operation of various operation knobs (e.g. a soft pedal and a brilliance operation knob), the simplest way would be to provide a plurality of memories, one for each of these different controls, and access a selected one of these memories. This, however, would necessitate a complex construction requiring a large memory capacity and therefore would be unrealistic. As an alternative, it has been conceived, as disclosed in Japanese Patent Preliminary Publication No. 60-55398, to prepare in a waveshape memory two types of continuous waveshapes, e.g., a continuous waveshape corresponding to the strongest touch and a continuous waveshape corresponding to the weakest touch in the case of the touch response control, read out the two waveshapes simultaneously and interpolate the two waveshapes in accrodance with a tone color change parameter (i.e., touch strength) to obtain a waveshape corresponding to the tone color change parameter (touch strength). Even in this case, however, a full waveshape from the start of sounding of the tone to the end thereof must be stored so that the problem of requiring a large memory capacity remains unsolved. Further, in this proposed system, it is desirable to bring waveshapes to be stored in phase with each other in storing the respective waveshapes so as to perform the interpolation operation smoothly. Since, however, copies of waveshapes of actually performed tones are generally used as two waveshapes to be stored in a waveshape memory, an operation for bringing the waveshapes in phase is not an easy task.

In natural musical instruments generally, tone color change characteristics according to the touch strength or tone color change characteristics according to the tone pitch or tone range are not uniform for all types of natural musical instruments but are different depending upon the kind of natural musical instrument. Such tone color change characteristics exhibiting proper characteristics of a particular musical instrument characterizes, together with the constant tone color of the musical instrument, a tone color proper to the musical instrument.

In the prior art devices including the above described patent and patent application, however, no consideration was given to such tone color change characteristics proper to each natural musical instrument in determining function characteristics for the interpolation operation. Accordingly, a common weighting function for interpolation had to be employed irrespective of the kind of tone color selected in an electronic musical instrument (corresponding typically to natural musical instruments such as piano and guitar). Consequently, the prior art devices failed to strictly simulate tone color change characteristics proper to respective natural musical instruments.

SUMMARY OF THE INVENTION

It is, therefore, an object of the invention to provide a tone signal generation device capable of generating a tone signal having a tone color controlled in accordance with the tone color control factors such as the key touch and key scaling with a memory of a reduced memory capacity.

It is another object of the invention to simplify phase matching between respective channels without deteriorating the tone quality of a tone obtained in a tone signal generation device generating a tone signal having a tone color controlled in accordance with the tone color control factors such as the key touch and key scaling by weighting waveshapes of plural systems.

It is still another object of the invention to realize rich tone color change characteristics as observed in natural musical instruments by enabling tone color change characteristics of a tone corresponding to the tone color control factors such as the key touch and key scaling to be set to characteristics proper to the tone corresponding to the respective tone color kinds.

It is an attack portion of a tone that listeners generally feel change in the tone color most strongly. A tone color change in a sustain portion of a tone does not impart to the listeners as strong an impression as one in the attack portion. Besides, the impression produced by the tone color change in the sustain portion is substantially effaced by the tone color change in a next attack portion so that the listeners scarcely perceive the tone color change in the sustain portion. For this reason, it is not absolutely necessary to impart a tone with a tone color change due to the key touch or key scaling over the entire period of sounding of the tone but a tone color change control will be sufficiently effected if the tone color change is imparted at least in the attack portion.

For the reason stated above, a tone signal generation device achieving one object of the invention is characterized in that it produces waveshapes of plural periods of at least an attack portion for plural channels, combines these waveshapes after properly weighting them and thereby generates a tone signal of the attack portion which is controlled in its tone color in accordance with the weighting, while using a tone signal generated in a single channel with respect to a sustain portion following the attack portion.

A tone signal generation device according to the invention achieving the same object of the invention is characterized in that it comprises attack memory means for storing plural attack data respectively constituting plural attack waveshapes relating to an attack portion of tone waveshape representing a tone signal to be generated, one of said plural attack data being reference data representing a specified one itself among said plural attack waveshapes and another one of said plural attack data representing the difference between said specified one and another one of said plural attack waveshapes, readout means for reading out the reference and difference data from said wavesahpe memory means, weighting data generation means for generating the weighting data, weighting means for weighting said read out difference data in accordance with weighting data, combining means for combining the weighted difference data and the read out reference data and for providing a new attack waveshape on the basis of the combined result and sustain waveshape generation means for generating a sustain waveshape signal corresponding to a sustain portion of said tone waveshape following generation of said new waveshape.

According to this tone signal generation device, since, as to the attack portion, waveshape signals of plural channels are combined after they are weighted, a tone color change can be imparted in accordance with the weighting. As to the sustain portion following the attack portion, no tone color change is imparted, for a tone signal is generated only in a single channel. Nevertheless, a sufficiently effective tone color change control can be achieved by imparting the tone color change to the attack portion of the tone as described above. Besides, a waveshape memory of a smaller memory capacity can be used, for it is only the attack portion that requires storage of waveshape data for waveshapes of plural periods for plural channels.

In a tone signal generation device which comprises waveshape memory means storing plural waveshape data respectively constituting plural waveshapes each of which consists of an attack portion and a sustain portion and is capable of generating a tone signal imparted with a tone color change by properly weighting and combining waveshape signals produced on the basis of waveshape data read out from the waveshape memory means, a device achieving the other object of the invention is characterized in that the sustain portions of said plural waveshapes to be stored in the waveshape memory means are previously adjusted in phase so that the sustain portions are in phase with each other and the phase-adjusted sustain portions are stored in the waveshape memory means.

A tone signal generation device achieving the same object of the invention is characterized in that it comprises waveshape memory means for storing first waveshape data representing a first waveshape and second waveshape data constituting a second waveshape, said first and second waveshape data respectively including attack portions of said first and second waveshapes which are not adjusted in phase and sustain portions of said first and second waveshapes which have been adjusted in phase by adjusting phase and said second waveshape data representing a difference between said first waveshape and said second waveshape, readout means for reading out said first and second waveshape data from said waveshape memory means, weighting data generation means for generating the weighted data, weighting means for weighting the read out second waveshape data in accordance with weighting data and combining means for combining the weighted second waveshape data and the read out first waveshape data together and for providing the combined signal as a tone signal.

According to the above described tone signal generation device, waveshape signals of plural channels are weighted and the weighted waveshape signals are finally combined with each other to obtain a single tone signal. The tone color of this tone signal is controlled in accordance with contents of this weighting. Since waveshape signals of the respective channels have been substantially brought in phase with each other in the sustain portion, no problem of cancelling of a waveshape due to phase difference occurs in the sustain portion of a tone signal obtained so that constant tone color and tone level are not impaired.

Since an attack portion of a tone tends to cause pitch variations and contains much noise content, the phase matching operation in the attack portion of a waveshape is rather difficult. On the other hand, a portion after the attack portion in which the waveshape becomes stable, i.e., a sustain portion, has relatively small pitch variations so that the phase matching operation is easy to perform. Besides, it is important for preventing deterioration of the constant tone color and tone level of a tone signal obtained by interpolating waveshapes of the respective channels that the waveshapes of the respective channels are in phase in their sustain portions. Accordingly, it is very advantageous to match the phase of waveshape data of plural channels with respect to the sustain portion thereof as described above.

In the above described tone signal generation device according to the invention, the device achieving the still other object of the invention is characterized in that it further comprises tone color selection means for selecting a tone color characterizing a tone signal to be generated and wherein the weighting data generation means generates the weighting data whose value corresponds to the selected tone color.

A weighting data representing proper characteristics corresponding to a selected tone color is generated. The waveshape signal is weighted in accordance with this weighting data and the weighted waveshape signal is finally combined for producing a tone signal. The tone color of this tone signal is variably controlled in a subtle manner in accordance with contents of the weighting. The function of the weighting data represents characteristics proper to the selected tone color kind so that tone color change characteristics realized thereby differ depending upon the tone color kind. Accordingly, tone color change characteristics in various natural musical instruments corresponding, for example, to the key touch or key scaling can be simulated more closely in accordance with characteristics proper to each tone color kind.

For example, contents of weighting of waveshape signals of respective channels are determined by the key touch. For another example, contents of such weighting are determined by tone pitch or tone range of a tone to be generated. For still another example, contents of such weighting are determined by an operation state of a brilliance operation knob or other operation knob.

Thus, a tone color change control is performed in accordance with the key touch or key scaling or operation state of an operation knob.

According to the invention, waveshapes of plural periods of an attack portion for plural channels having characteristics different from each other are stored in memories and attack portion waveshape data for the respective channels read out from these memories are properly weighted to impart the attack portion waveshape with a tone color change control corresponding to this weighting whereas as to the sustain portion waveshape no such weighting is made but a common waveshape is used so that the memory capacity of the waveshape memory can be reduced and yet a practically effective tone color change control can be realized because a tone color change is accurately imparted to the attack portion about which listeners feel the tone color change most strongly.

According to another feature of the invention, waveshape data of the attack portion for one channel only is stored and waveshape data of a difference waveshape between the waveshape data of the attack portion and waveshape data of another attack portion different therefrom is also stored and the waveshape data of the difference waveshape is properly weighted and combined with the waveshape data of the attack portion of one channel to produce a tone signal of the attack portion which is controlled in tone color in accordance with the weighting and, accordingly, the memory capacity can be reduced by the amount the difference waveshape is stored as compared with a case where waveshape data of the attack portion for two channels are directly stored.

Further, according to the invention, waveshape data of plural periods of the attack portion and the sustain portion for plural channels having characteristics different from each other are respectively stored in a memories and waveshape signals obtained on the basis of the waveshape data for the respective channels read out from the memories are properly weighted in accordance with weighting data and thereafter combined with each other to perform a tone color change control in accordance with the weighting and, accordingly, a tone signal of a high quality can be obtained and the tone color of this high-quality tone signal can be subtly controlled in accordance with various tone color control factors. Further, this tone color control can be achieved with a waveshape memory of a reduced memory capacity. In particular, according to the invention, in order to prevent cancelling of waveshape content due to phase difference between waveshape data in combining waveshape signals on the basis of weighted waveshape data of plural channels, phase adjusting is previously performed so as to match the phases of waveshape data of sustain portions of the respective channels to a maximum extent possible and waveshape data matched in phase are stored in a memory so that it can solve the problem which tends to occur most frequently in the sustain portion in a case where the waveshape data are combined with each other with the phase difference therebetween unadjusted. Besides, the phase matching operation for matching the phases of the waveshape data of the sustain portions for the respective channels can be readily realized so that the invention is advantageous in this respect also.

According to the further feature of the invention, only one of waveshape data of two channels which are previously adjusted in phase with respect to the sustain portion is stored in a memory and waveshape data of a difference waveshape between the waveshapes of the two channels is stored, and a waveshape signal obtained on the basis of the waveshape data of the difference waveshape read out from the memory is properly weighted and thereafter is combined with a waveshape signal obtained on the basis of the waveshape data for one channel read out from the memory to produce a tone signal and, accordingly, the memory capacity can be reduced by an amount the difference waveshape has been stored as compared with a case where waveshape data for the two channels are directly stored.

Further, according to the invention, since the function of the weighting data represents characteristics proper to a selected tone color kind, the tone color change characteristics realized thereby differ depending upon tone color kind. Accordingly, tone color change characteristics corresponding, for example, to the key touch or key scaling in various natural musical instruments can be more closely simulated.

BRIEF DESCRIPTION OF THE DRAWINGS

In the accompanying drawings,

FIGS. 4*a*–4*c* are diagrams shwoing an example of amplitude envelope shape;

FIGS. 5*a* and 5*b* are graphical diagrams showing an example of a weighting function;

FIG. 6 is a block diagram showing a modified example of a waveshape memory and a weighting circuit of an attach portion shown in FIG. 1;

DESCRIPTION OF PREFERRED EMBODIMENTS

Embodiments of the present invention will now be described in conjunction with the accompanying drawings.

Figure 1:
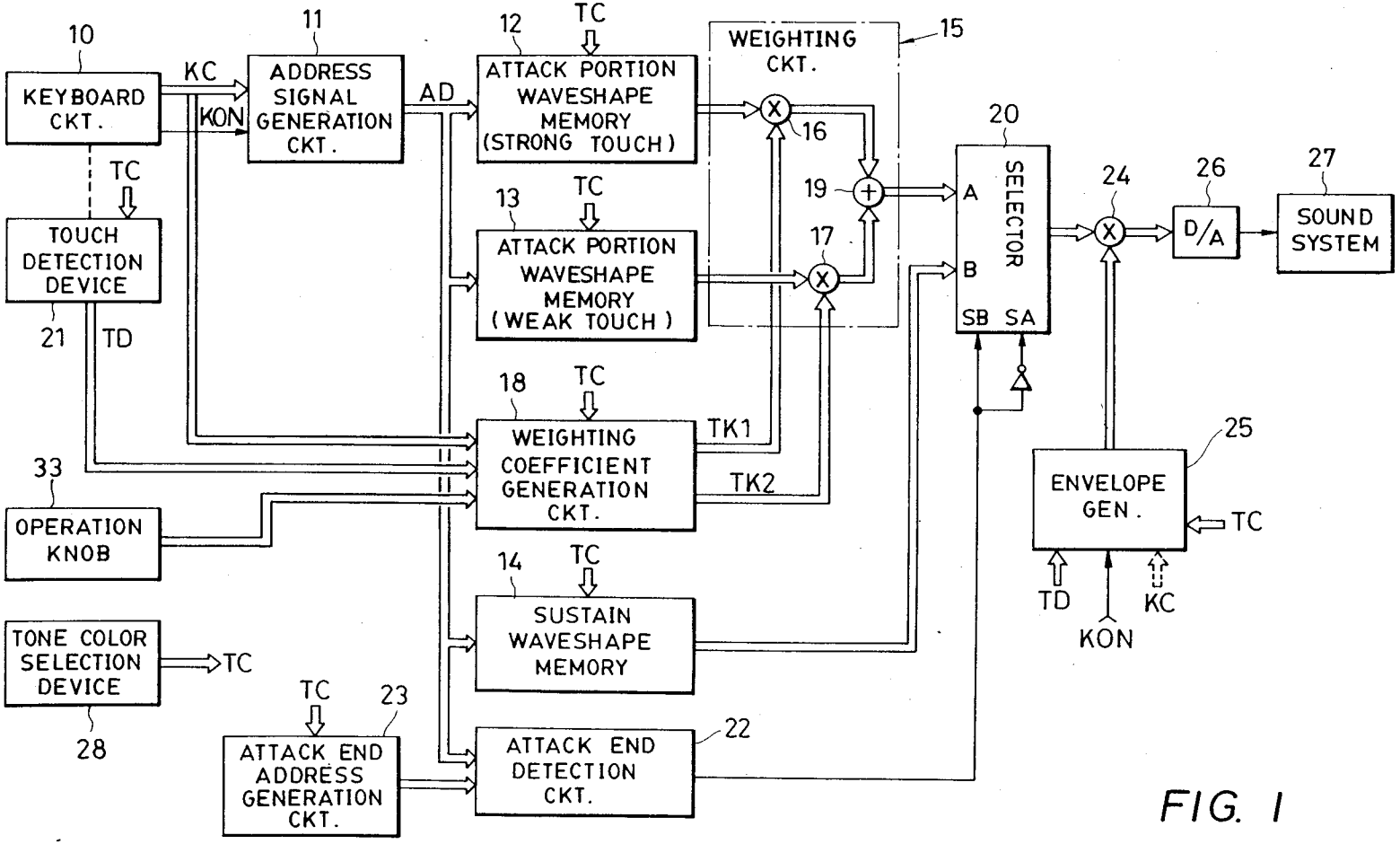
FIG. 1 is a block diagram showing an entire construction of an electronic musical instrument incorporating an embodiment of the invention.

FIG. 1 is an electrical block diagram showing an embodiment of an electronic musical instrument incorporating the tone signal generation device accroding to the invention. In this embodiment, a keyboard is employed as means for designating a pitch of a tone signal to be generated. An address signal generation circuit 11 corresponds to readout means for reading out waveshape data from waveshape memories 12, 13 and 14 in accordance with a tone pitch designated by the keyboard. The circuit 11 receives a key code KC representing a depressed key and generates an address signal AD which changes at a rate corresponding to the tone pitch of the key represented by the key code KC.

The first waveshape memory 12 stores waveshape data of plural periods of at least an attack portion with respect to a waveshape having certain characteristics (hereinafter conveniently called "first waveshape"). The second waveshape memory 13 stores waveshape data of plural periods of at least an attack portion with respect to a waveshape having characteristics (hereinafter conveniently called "second waveshape") which is different from the first waveshape.

The sustain waveshape memory 14 stores waveshape data of a waveshape of a sustain portion following the attach portion (preferably a waveshape of plural periods).

The address signal generation circuit 11 initially generates, in response to a key-on signal KON provided from a keyboard circuit 10, an address signal AD for reading out the waveshape data of the attack portion and then an address signal AD for reading out the waveshape data of the sustain portion. The waveshape data of the attsack portion are read out in parallel to each other from the first and second waveshape memories 12 and 13 and supplied to multipliers 16 and 17 in a weighting circuit 15. The weighting circuit 15 gives weighting to waveshape data of respective channels in response to weighting coefficients (weighting control data) TK1 and TK2 generated for the respective channels by a weighting coefficient generation circuit 18. More specifically, the coefficient TK1 is applied to the multiplier 16 for weighting the waveshape data read out from the first waveshape memory 12 whereas the coefficient TK2 is applied to the multiplier 17 for weighting the waveshape data read out from the second waveshape memory 13. The waveshape data of the second channel respectively weighted are combined with each other in the manner of addition by an adder 19 and thereafter is applied to an A input of a selector 20.

A touch detection device 21 detects touch of the key depressed in the keyboard and supplies touch detection data TD representing the detected key touch to the weighting coefficient generation circuit 18. The weighting coefficient generation circuit 18 generates the weighting coefficients TK1 and TK2 which indicate weighting amounts corresponding to the touch detection data TD.

In this embodiment, the first waveshape memory 12 stores waveshape of the attack portion having characteristics corresponding to the strongest key touch whereas the second waveshape memory 13 stores waveshape of the attack portion having characteristics corresponding to the weakest key touch. In the weighting circuit 15, therefore, interpolation is made between the waveshape data corresponding to the strongest touch and the one corresponding to the weakest touch in response to the weighting coefficients TK1 and TK2 corresponding to the key touch and, as a result, a tone waveshape signal of the attack portion having characteristics corresponding to the key touch applied at that time is produced.

An attack and detection circuit 22 compares an attack end address value provided by an attack end address generation circuit 23 with the address signal AD thereby to detect whether or not the reading out of the waveshape of the attack portion has been completed. This circuit 22 produces a signal "0" while the waveshape of the attack portion is being read out and a signal "1" when the reading has been completed. An output signal of the attack end detection circuit 22 is applied to a B selection control input SB of the selector 20 and a signal obtained by inverting this signal is applied to an A selection control input SA.

Accordingly, while the waveshape data of the attack portion are being read out from the first and second waveshape memories 12 and 13, the A input is selected in the selector 20 to weight these waveshape data and the added and combined waveshape data is provided from the selector 20. To the B input of the selector 20 is supplied the waveshape data of the sustain portion read out from the sustain waveshape memory 14 and, when the reading out of the attack portion has been completed, the waveshape data of this sustain portion is selected by the selector 20 and delivered out.

The waveshape data provided from the selector 20 is supplied to a multiplier 24 in which the waveshape data is multiplied with amplitude envelope shape data generated by an envelope generator 25. An output of the multiplier 24 is supplied to a digital-to-analog converter 26 in which it is converted to an analog signal. Then, the converted analog signal is supplied to a sound system 27.

Specific examples of waveshapes to be stored in the waveshape memories 12, 13 and 14 will now be described.

Figure 2:
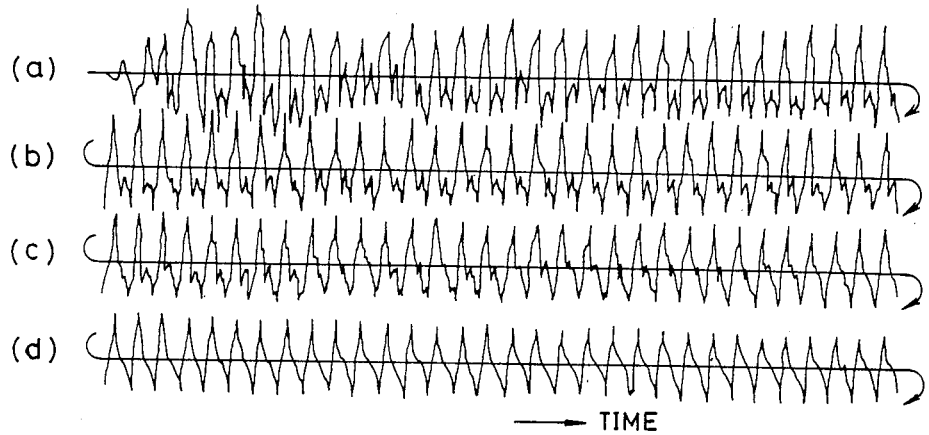
FIG. 2 is a waveshape diagram showing an example of a tone waveshape of an actual piano tone played with a strong touch.
Figure 3:
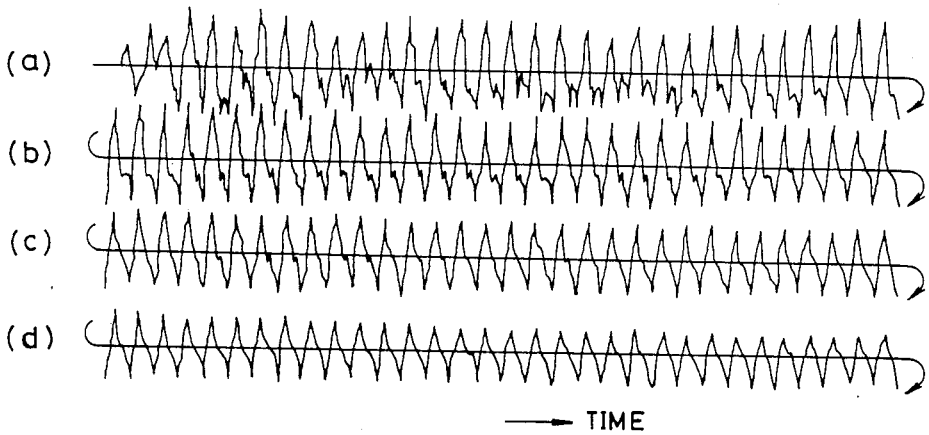
FIG. 3 is a waveshape diagram showing an example of a tone waveshape of an actual piano tone played with a weak touch.

FIG. 2 shows an example of a waveshape of an actual piano sound (original waveshape) played with a strong touch. FIG. 3 shows an example of a waveshape of an actual piano sound (original waveshape) played with a weak touch. For convenience of illustration, chronologically continuous waveshapes in these figures are divided into four parts of parts (a), (b), (c) and (d). In a tone waveshape, it is rather difficult to strictly define a borderline between the attack portion and the sustain portion. A waveshape portion from the beginning of sounding of the tone to approximately a portion in which the shape and amplitude of the waveshape becomes stable is generally called the attack portion and the subsequent portion is called the sustain portion. In FIGS. 2 and 3, therefore, the parts (a) and (b) are roughly the attack portion and the parts (c) and (d) are the sustain portion. There is certain latitude in the manner of dividing the waveshape and the part (a) and the former half of the part (b) may be called the attack portion or, alternatively, the part (a) may be called the attack portion and the subsequent parts the sustain portion.

In the first waveshape memory 12, waveshape data of a waveshape of plural periods of an attack portion corresponding to a strong touch as shown in the parts (a) and (b) in FIG. 2 is stored in a memory area corresponding to a piano tone color. In the second waveshape memory 13, waveshape data of a waveshape of plural periods of an attack portion corresponding to a weak touch as shown in the parts (a) and (b) in FIG. 3 is stored in a memory area corresponding to a piano tone color. It should be noted that the waveshape memories 12 and 13 need not necessarily store the waveshape of the attack portion only but they may store a part of the sustain portion as well.

The waveshape of the sustain portion for one channel only is stored in the sustain waveshape memory 14. The waveshape of the sustain portion to be stored may be either one of the sustain waveshape corresponding to a strong touch as shown in the parts (c) and (d) in FIG. 2 and the sustain waveshape corresponding to a weak touch as shown in the parts (c) and (d) in FIG. 3 but should preferably be a sustain waveshape which is formed by suitably adding the two sustain waveshapes together and therefore can be used commonly for any strength of touch. The waveshape of the sustain portion stored in the memory 14 may be an entire waveshape following the waveshape of the attack portion stored in the memories 12 and 13 or, alternatively, a waveshape portion of plural periods taken suitably out of the entire waveshape following the attack portion or a representative waveshape of one period. In a case where the full waveshape to the end of sounding of the tone is stored in the sustain waveshape memory 14, a control is made so that waveshape data of the sustain portion stored in the memory 14 is read out only once in response to the address signal AD generated by the address signal generation circuit 11. In a case where a waveshape of limited plural periods or one period is stored in the memory 14, a control is made so that waveshape data stored in the memory 14 is repeatedly read out in response to the address signal AD. Since the control for reading such waveshape data once or repeatedly is well known, detailed description thereof will be omitted. Reading of waveshape data from the sustain memory 14 is started after reading of waveshape data of the attack portion from the memories 12 and 13 has substantially been completed and this can be readily controlled by suitably determining the reading start address in the memory 14.

Instead of the original waveshapes having natural amplitude envelopes as shown in FIGS. 2 and 3, waveshape data obtsained by coding these original waveshapes in accordance with some coding system such as PCM (pulse code modulation) system may be stored in these waveshape memories 12, 13 and 14. In this case, the envelope generator 25 generates envelope shape data as shown in FIG. 4*a* having characteristics which maintains a constant level during depression of the key and decays upon release of the key. The decaying envelope shape generated upon release of the key is required for, as is well known, effecting a damp control upon release of the key in a case where the tone waveshape of the sustain portion has decaying envelope characteristics of a percussive sound and for attenuating sound upon release of the key in a case where the tone waveshape of the sustain portion has envelope characteristics of a sustain tone (or in a case where the tone waveshape has substantially come to have envelope characteristics of a sustain tone by repeated reading of the same waveshape).

Instead of storing the original waveshape having natural amplitude envelopes, data processing may previously be made so as to standardize the amplitude level (i.e., a peak level of each single wave) of the original waveshape to a predetermined level (characteristics of each single wave are not impaired by such processing) and waveshape data obtained by coding the waveshape having such standardized amplitude level in accordance with a suitable coding system such as PCM system may be stored in the memories 12, 13 and 14. In this case, the envelope generator 25 generates envelope shape data having suitable amplitude envelope characteristics as shown in FIG. 4*b* or 4*c* thereby to impat amplitude envelopes such as attack, decay and sustain to the tone waveshape data having the standardized amplitude level. The storage of such waveshape data having the standardized amplitude level in the memories 12–14 is advantageous in that the bit number in data expression is increased by increasing the apparent level of the waveshape which is actually of a relatively small amplitude level whereby resolution in reproducing the waveshape can be increased. It is further advantageous that this can be realized by effectively utilizing the memories without particularly increasing the memory capacity of these memories. Further, since the amplitude level of the waveshape data (the peak level of each single wave) read out from the waveshape memories 12, 13 and 14 are common through the attack portion and the sustain portion, no difference in the level between the waveshape of the attack portion and the one of the sustain portion is produced when the waveshape to be selected by the selector 20 has been changed so that an abrupt change in the tone volume nd occurrence of clicking can be prevented.

The waveshape memories 12, 13 and 14 respectively store waveshape data of the attack portion and the sustain portion for respective tone color kinds selectable by a tone color selection device 28. The tone color selection device 28 produces a tone color selection information TC representing a selected tone color and supplies this information to the waveshape memories 12, 13 and 14 and other circuits. The waveshape memories 12, 13 and 14 are enabled to read out a waveshape corresponding to the tone color designated by the supplied tone color selection information TC and reads out waveshape data of this waveshape in response to the address signal AD in the above described manner.

The tone color selection information TC is applied also to the weighting coefficient generation circuit 18 so that functon characteristics of the weihgting coefficients TK1 and TK2 for the touch strength become different depending upon the selected tone color kind. Examples of the different function characteristics are shown in FIGS. 5*a* and 5*b*. In FIG. 5*a*, a function of the weighting coefficient TK1 of one channel for touch detection data TD is shown whereas in FIG. 5*b*, a function of the weighting coefficient TK2 of the other channel is shown. In these figures, a solid line indicates an example of such functions for a piano tone color whereas a dotted line indicates an example of such functions for a guitar tone color. The sharp inclination of the function for the piano tone color signifies that degree of tone color change depending upon the key touch is great. By such change in the tone color change characteristics in accordance with the tone color, tone color change characteristics in various natural musical instruments can be more closely simulated. The tone color selection information TC may be supplied also to the touch detection device 21 so that characteristics of the touch detection data become different depending upon the tone color kind.

Since waveshapes of the attack portion stored in the waveshape 12 and 13 differ depending upon the tone color, length of address of these waveshapes also differ from one another. In detecting the end of the attack portion by the attack end detection circuit 22, therefore, difference in the length of address of the attack portion corresponding to the selected tone color must be taken into account. To this end, the tone color selection information TC is applied to the attack end address generation circuit 23 so that an attack end address value corresponding to the selected tone color is generated.

The tone color selection information TC is also supplied to the envelope generator 25 so that characteristics (such as curve, level and time of attack, decay, sustain and damp) of an envelope shape to be generated are controlled in accordance with the selected tone color. The touch detection data TD also is supplied to the envelope generator 25 so that maximum level of the envelope shape is controlled in accordance with the key touch strength.

FIG. 6 shows a modified example of the embodiment of FIG. 1. A first waveshape memory 12A stores waveshape data of plural periods of an attack portion of a waveshape corresponding to a weak touch (e.g. a waveshape as shown in FIG. 3). A second waveshape memory 13A stores waveshape data of a difference waveshape between a waveshape corresponding to a strong touch (e.g. a waveshape as shown in FIG. 2) and the waveshape corresponding to the weak touch stored in the first waveshape memory 12A. A weighting circuit 15A comprises a multiplier 29 which multiplies the waveshape data of the difference waveshape read out from the second waveshape memory 13A with a weighting coefficient TK and an adder 30 which adds the waveshape data corresponding to the weak touch read out from the first waveshape memory 12A and an output of the multiplier 29 together. A weighting coefficient generation circuit 18A generates a signal "1" when the key touch is the strongest and a signal "0" when the key touch is the weakest and generates the weighting coefficient TK satisfying the condition $0<TK<1$ depending upon the touch strength between "1" and "0" in accordance with a predetermined function. Function characteristics of the weighting coefficient TK preferably differ depending upon the selected tone color. In the example of FIG. 6, the rate of addition of the difference waveshape data relative to the waveshape data corresponding to the weak touch read out from the first waveshape memory 12A is controlled in accordance with the key touch strength and, as a result, waveshape data of the attack portion having characteristics corresponding to the touch strength is provided by the weighting circuit 15A in the same manner as in the embodiment of FIG. 1. According to this construction, since the waveshape memory 13A is a difference waveshape memory, the memory capacity of the memory can be further reduced. Alternatively, waveshape data of the attack portion corresponding to the strongest touch may be stored in the first waveshape memory 12A and the adder 30 may be replaced by a subtractor.

Since the difference waveshape stored in the memory 13A is a difference between amplitude of respective sample points of the waveshape corresponding to the strongest touch and amplitude of corresponding sample points of the waveshape corresponding to the weakest touch, it is a rugged waveshape abundant in harmonic content. If this rugged difference waveshape is added to the waveshape corresponding to the weak touch even at a small level, the added and combined waveshape is likely to become one which is abruptly changed from the waveshape corresponding to the weak touch and also is different from a waveshape of a tone of a natural musical instrument. For preventing this, the example of FIG. 6 may be modified to an example shown in FIG. 7 in which a digital filter (low-pass filter) 31 is provided on the output side of the second waveshape memory 13A, a filter characteristics parameter is read out from a filter characteristics parameter memory 32 in response to the touch detection data TD, and the filter 31 is controlled by this parameter. This filter control is made in such a manner that a relatively more rounded difference waveshape is produced from the filter 31 as the key touch becomes weaker and, as the key touch becomes stronger, a difference waveshape which is more closely resembling the original difference waveshape produced by the waveshape memory 13A which is relatively not much rounded is produced from the filter 31. When the touch is the strongest one, the output waveshape of the waveshape memory 13A is produced from the filter 31 without any modification being applied thereto. By such control, the difference waveshape added to the waveshape corresponding to the weakest touch (the output of the memory 12A) when the touch is relatively weak can be made a relatively smooth one containing less harmonic content and, consequently, the above described inconvenience can be effectively removed. Alternatively, the tone color selection information TC may be applied to the memory 32 and the filter characteristics parameter may be read out not only in response to the key touch but also to the selected tone color. The digital filter 31 may be provided on the output side of the multiplier 29.

Figure 7:
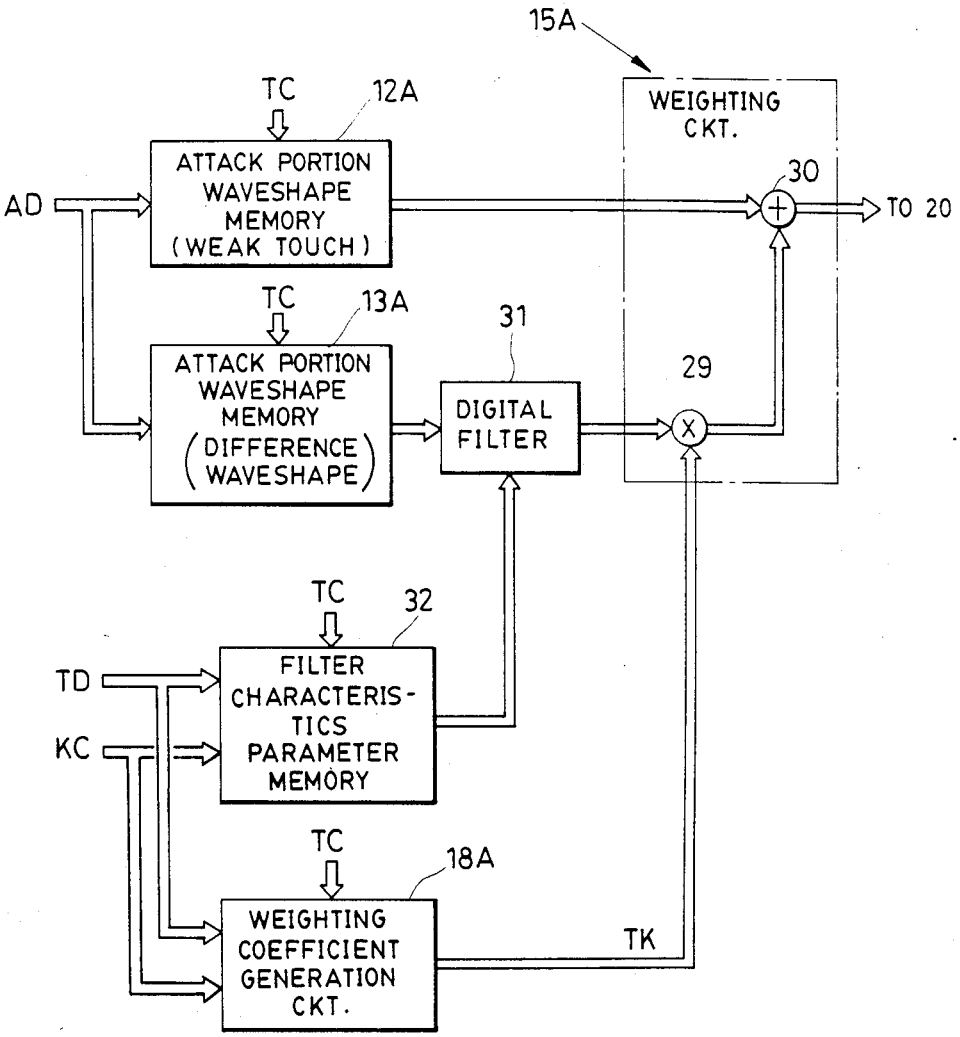
FIG. 7 is a block diagram showing a modified example of FIG. 6.

In a case where a tone color change control is to be made in accordance with the tone pitch or tone range of a tone to be generated (i.e., key scaling), the key code KC may be applied instead of the touch detection data TD as input data to the weighting circuits 18 and 18A (FIGS. 1, 6 and 7). The key code KC is also applied to the envelope generator 25 so as to control the maximum level and decay time of the envelope shape.

In a case where a tone color change control is made in accordance with an operation state of a predetermined operation knob 33 (FIG. 1), an output of the operation knob 33 may be applied instead of the touch detection data TD or the key code KC as input data to the weighting coefficient generation circuits 18 and 18A.

In a case where the circuit of FIG. 1, FIG. 6 or FIG. 7 is utilized for the control corresponding to the key scaling or the operation knob manipulation, the waveshapes to be stored in the first and second memories 12, 12A, 13 and 13A are not ones corresponding to the strongest and weakest touches but ones corresponding to a high tone pitch and a low tone pitch, or ones corresponding to large and small amounts of operation of the operation knob.

Figure 8:
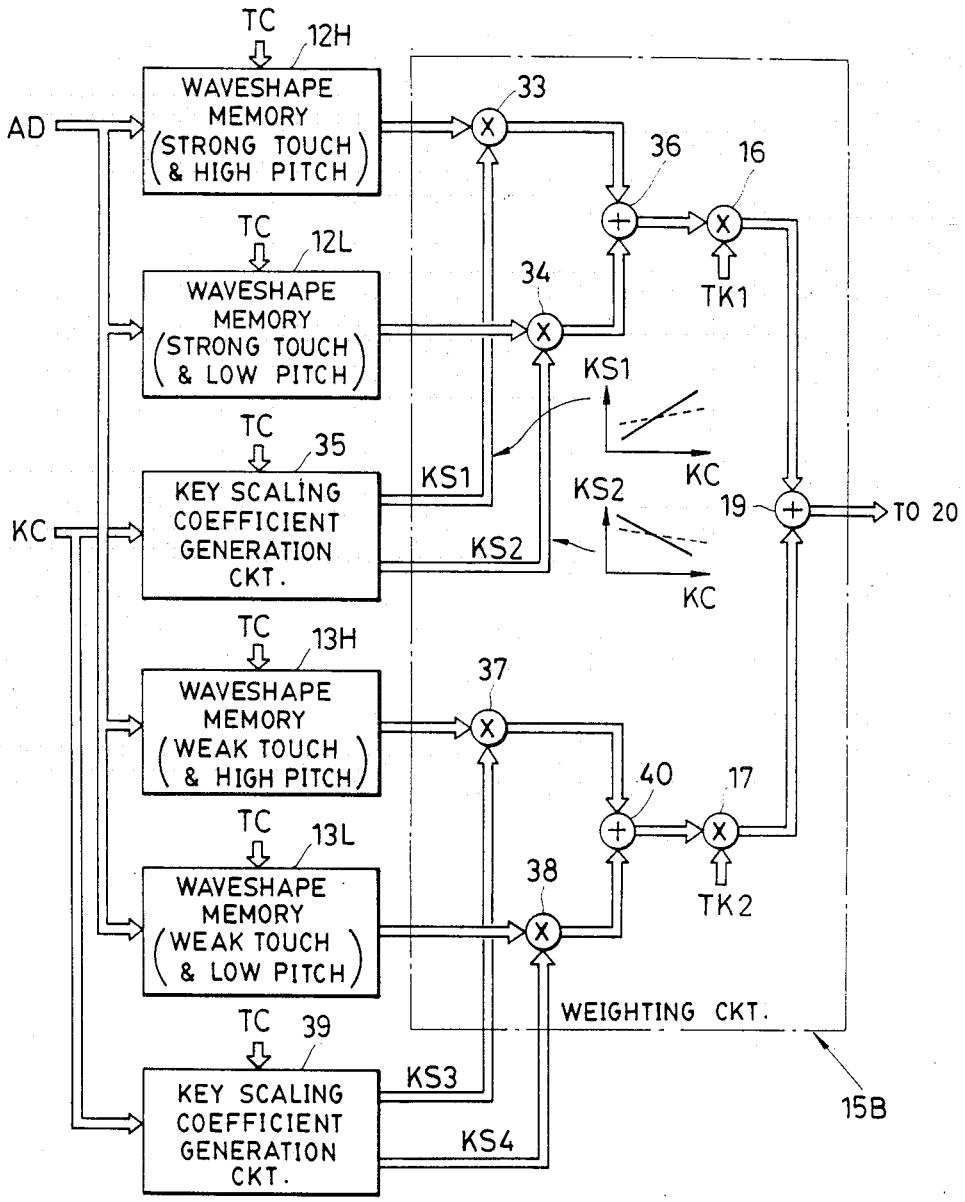
FIG. 8 is a block diagram showing a modified example of a waveshape memory and a weighting circuit of an attack portion shown in FIG. 1 in a case where a tone color change is imparted by combining a plurality of tone color control factors.

The tone color change control may also be made by combining any ones of the key touch, the key scaling and the operation state of the operation knob 33. FIG. 8 shows an example of such combination partially. This portion substitutes the first and second waveshape memories 12 and 13 and the weighting circuit 15 of FIG. 1. A waveshape memory 12H stores, for respective tone color, waveshape data of a waveshape of plural periods of an attack portion having tone color characteristics corresponding to a strong key touch and a high tone pitch in the same manner as was previously described. A waveshape memory 12L stores, for respective tone colors, waveshape data of a waveshape of plural periods of the attack portion having tone color characteristics corresponding to a strong key touch and a low tone pitch in the same manner as was previously described. A waveshape memory 13H stores, for respective tone colors, waveshape data of a waveshape of plural periods of the attack portion having tone color characteristics corresponding to a weak key touch and a high tone pitch in the same manner as was described previously. A waveshape memory 13L stores, for respective tone colors, waveshape data of a waveshape of plural periods of the attack portion having tone color characteristics corresponding to a weak key touch and a low tone pitch in the same manner as was previously described. In the same manner as described above, these waveshape memories 12H–13L for the attack portion are enabled to read out waveshape data corresponding to the tone color kind selected in response to the tone color selection information TC and reads out this waveshape data at a suitable tone pitch frequency in response to the address signal AD.

The waveshape data corresponding to the strong key touch read out from the waveshape memories 12H and 12L are respectively applied to multipliers 33 and 34 provided for performing weighting for the key scaling operation. The multipliers 33 and 34 receive, at another input thereof, key scaling coefficients KS1 and KS2 of two channels generated by a key scaling coefficient generation circuit 35 in response to the key code KC whereby weighting corresponding to the tone pitch of a tone to be generated is imparted to both waveshape data for the strong touch. Outputs of the multipliers 33 and 34 are added together by an adder 36 and the added signal is applied to a multiplier 16 in which the weighting coefficient TK1 corresponding to the key touch as described above is multiplied.

In the same manner as described above, outputs of the waveshape memories 13H and 13L are applied to multipliers 37 and 38 in which they are multiplied with key scaling coefficients KS3 and KS4 generated by a key scaling coefficient generation circuit 39 in response to the key code KC. Weighting corresponding to the tone pitch of the tone to be generated is thereby imparted to both waveshape data. Outputs of the multipliers 37 and 38 are added together by an adder 40 and supplied to a multiplier 17 in which the weighting coefficient TK2 corresponding to the key touch as described above is multiplied.

Outputs of the multipliers 16 and 17 are added together by an adder 19 and applied to an A input (FIG. 1) of the selector 20. In this manner, waveshape data of the attack portion of the four channels having characteristics different from one another read out from the waveshape memories 12H–13L are respectively weighted in accordance with the tone pitch and the key touch of the tone to be generated whereby waveshape data of the attack portion imparted with a tone color change in accordance with these tone color control factors is provided by a weighting circuit 15B.

The key scaling coefficient generation circuits 35 and 39 respectively receive the tone color selection information TC. As described previously, function characteristics of the key scaling coefficients differ depending upon the tone color kind (e.g., as shown in FIG. 5) so that function characteristics of the key scaling coefficients KS1–KS4 to be generated are determined in accordance with the selected tone color. Instead of providing separate key scaling coefficient generation circuits 35 and 39, a single key scaling coefficient circuit may be commonly used.

In the example of FIG. 8, the weighting operation corresponding to the key touch is performed after the weighting operation for the key scaling is performed. This order however may be reversed. In a case where the tone color change control corresponding to the operation state of the operation knob is combined with the tone color control change corresponding to the key touch or the key scaling, a similar construction to the one shown in FIG. 8 can be employed. Further, all of the key touch, the key scaling and the operation knob control may be combined together and a similar construction to the one shown in FIG. 8 can also be employed.

Figure 9:
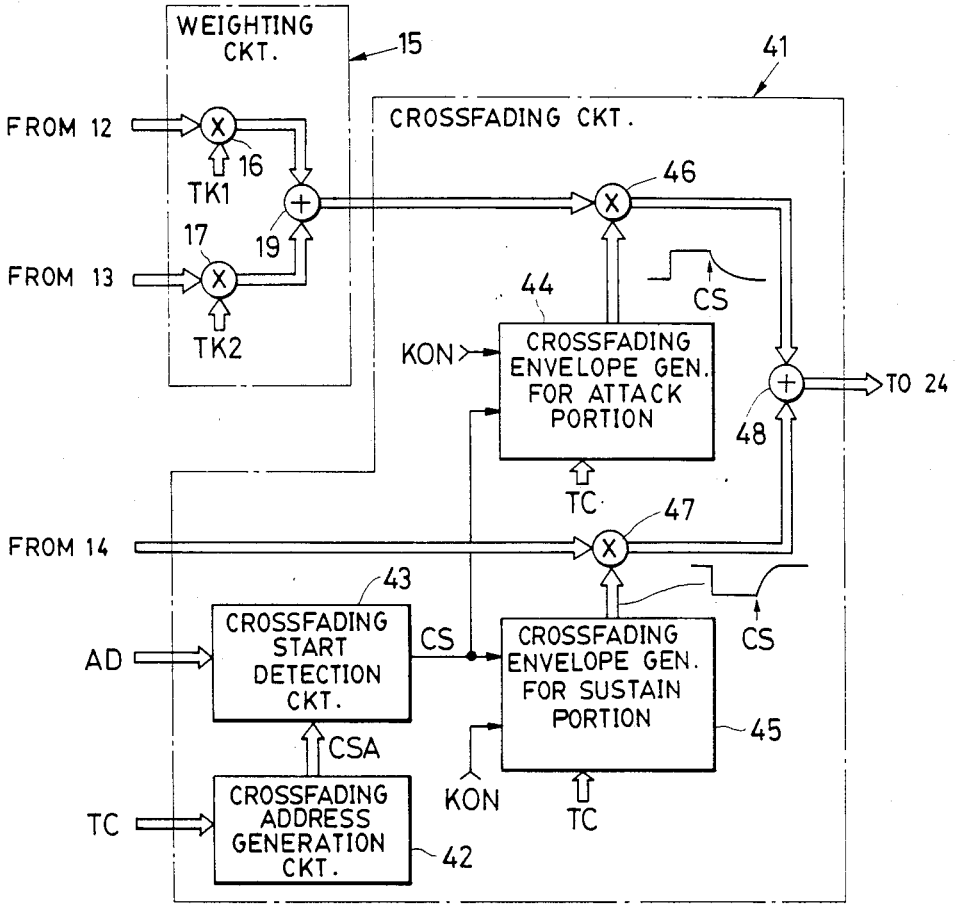
FIG. 9 is a block diagram showing an example of a crossfading circuit which is replaceable with a selector shown in FIG. 1.

In the embodiment of FIG. 1, since the waveshape of the attack portion is switched instantaneously by the waveshape of the sustain portion in the selector 20, there may be a case in which the two waveshapes do not continue smoothly. For overcoming such problem, a crossfading circuit 41 as shown in FIG. 9 may be employed instead of the selector 20 in FIG. 1.

Figure 10:
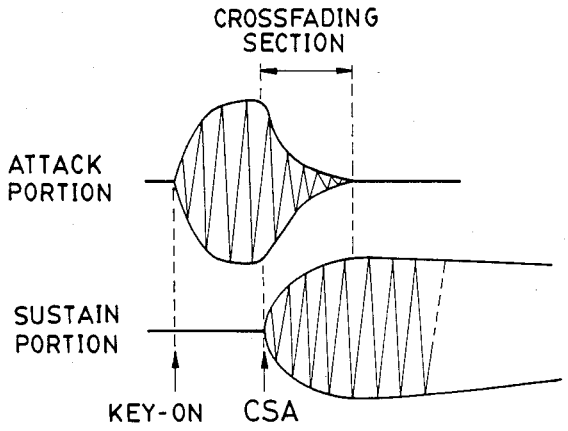
FIG. 10 is a waveshape diagram showing an example of weighting of waveshapes in the attack and sustain portions executed by the crossfading circuit.

As shown in FIG. 10, the crossfading circuit 41 weights the waveshape of the attack portion with a decay envelope and the waveshape of the sustain portion wth an attack envelope in the junction of the attack portion and the sustain portion and adds the two waveshapes together to switch the waveshape from the attack portion to the sustain portion smoothly (crossfading).

A crossfading address generation circuit 42 generates an address value for initiating crossfading (i.e. crossfading start address CSA) in response to the tone color selection information TC. A crossfading start detection circuit 43 compares the crossfading start address CSA with the address signal AD and, when the two signals coincide with each other, produces a crossfading start signal CS. The crossfading start signal CS is supplied to crossfading envelope generators 44 and 45.

The crossfading envelope generator 44 for the attack portion generates an envelope signal of a constant level corresponding to a multiplier "1" during a period of time from rising of the key-on signal KON to "1" till application of the crossfading start signal CS and, upon receipt of the crossfading start signal CS, generates an envelope signal which decays with a predetermined decay curve. This decay curve is controlled by the tone color selection information TC. The envelope signal produced by the crossfading envelope generator 44 for the attack portion is applied to a multiplier 46 in which it is multiplied with waveshape data provided by the weighting circuit 15.

The crossfading envelope generator 45 for the sustain portion generates a signal corresponding to a multiplier "0" during a period of time from rising of the key-on signal KON to "1" till application of the crossfading start signal CS (i.e., no envelope signal is generated) and, upon receipt of the crossfading start signal CS, generates an envelope signal which rises with a predetermined attack curve and thereafter maintains a constant level corresponding to the multiplier "1". This attack curve is controlled by the tone color selection information TC. The envelope signal produced by the crossfading envelope generator 45 for the sustain portion is applied to a multiplier 47 in which it is multiplied with waveshape data provided by the sustain waveshape memory 14.

Outputs of the multipliers 46 and 47 are added together by an adder 48 and the result of the addition is supplied to a multiplier 24 provided for imparting an amplitude envelope. Thus, the waveshape of a tone signal can be switched from the waveshape of the attack portion to the one of the sustain portion smoothly in the crossfading section. The employment of such crossfading circuit 41 is advantageous in that no strict consideration needs to be given to the connection between the attack portion and the sustain portion in preparing waveshape data to be stored in the waveshape memories 12, 13 and 14.

Figure 11:
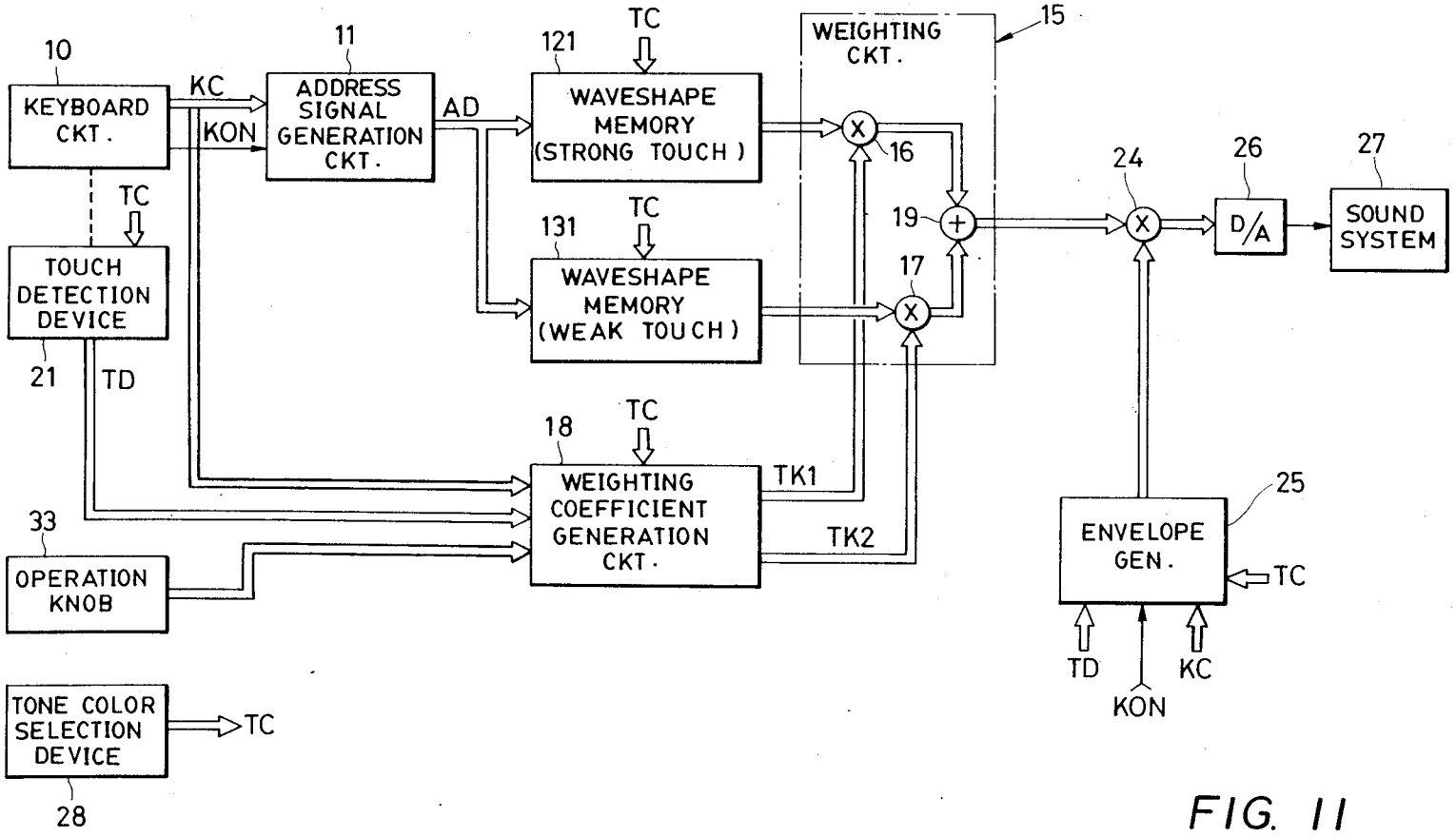
FIG. 11 is a block diagram showing an entire construction of an electronic musical instrument incorporating another embodiment of the invention.

FIG. 11 shows another embodiment of the invention. In FIG. 11, blocks affixed with the same reference characters as those of FIG. 1 perform the same or similar functions as those of FIG. 1. In this embodiment, it is not only a waveshape of an attack portion but also a waveshape of a sustain portion that is subject to weighting by a weighting circuit 15. Accordingly, memories are not divided into the waveshape memories 12 and 13 for the attack portion and the waveshape memory 14 for the sustain portion as in the memories of FIG. 1 but waveshape memories 121 and 131 store waveshape data of both the attack portion and the sustain portion together. More specifically, the first waveshape memory 121 stores waveshape data of plural periods consisting of an attack portion and a sustain portion for a waveshape having certain characteristics (hereinafter conveniently called "first waveshape"). The second waveshape memory 131 stores waveshape data of plural periods consisting of an attack portion and a sustain portion for a waveshape having characteristics different from those of the first waveshape (hereinafter conveniently called "second waveshape"). An important feature in the embodiment of FIG. 11 resides in the phase relationship between waveshape data stored in the phase relationship between waveshape data stored in the waveshape memories 121 and 131. That is, while no particular phase matching is performed with respect to the attack portion, phase adjustment is previously performed between the two channels with respect to the sustain portion so that the waveshapes of the two channels are in phase to the greatest extent possible.

In a similar manner to the embodiment of FIG. 1, a waveshape having characteristics corresponding to the strongest key touch is stored in the first waveshape memory 121 whereas a waveshape having characteristics corresponding to the weakest key touch is stored in the waveshape memory 131. In the weighting circuit 15, therefore, interpolation is made between waveshape data corresponding to the strongest touch and waveshape data corresponding to the weakest touch in response to weighting coefficients TK1 and TK2 depending upon the key touch and, as a result, a tone waveshape signal having characteristics corresponding to the strength of the key touch applied at that time is produced.

The waveshape data produced by the weighting circuit 15 is supplied to a multiplier 24 in which it is multiplied with amplitude envelope shape data generated by an envelope generator 25. An output of the multiplier 24 is supplied to a digital-to-analog converter 26 in which it is converted to an analog signal. Then the converted signal is supplied to a sound system 27.

Examples of waveshapes to be stored in the waveshape memories 121 and 131 will now be described with reference to FIGS. 2 and 3 previously referred to.

In the first waveshape memory 121, waveshape data a waveshape of plural periods of the attack portion corresponding to a strong touch as shown in the parts (a) and (b) in FIG. 2 is stored in a memory area corresponding to a piano tone color and then waveshape data of a waveshape of plural periods of the sustain portion corresponding to a strong touch as shown in the parts (c) and (d) in FIG. 2 is successively stored in a state in which the data has undergone a phase matching processing as will be described later. In the second waveshape memory 131, waveshape data of a waveshape of plural periods of the attack portion corresponding to a weak touch as shown in the parts (a) and (b) in FIG. 3 is stored in a memory area corresponding to a piano tone color and then waveshape data of a waveshape of plural periods of the sustain portion corresponding to a weak touch as shown in the parts (c) and (d) in FIG. 3 is successively stored in a state in which the data has undergone a phase matching processing as will be described later.

The phase matching processing of the waveshape data of the sustain portion to be stored in the waveshape memories 121 and 131 is performed, for example, in the following manner.

Waveshapes of plural periods to be stored as the sustain portion (e.g., waveshapes shown in the parts (c) and (d) in FIG. 2 and in the parts (c) and (d)in FIG. 3) are respectively taken out of two original waveshapes which are of the same pitch but are played with different touches. Then, phases of waveshape data of the two original waveshape of the sustain portion thus taken out are adjusted for decreasing phase difference between the two waveshapes so that the two waveshapes are not much out of phase with each other. This phase matching processing may be performed by, for example, dividing the original waveshape of the sustain portion into plural frames and performing phase adjusting frame by frame. For such phase adjusting frame by frame, means such as a digital filter or spectrum analysis may be utilized.

More specifically, the original waveshapes of the sustain portion corresponding to the strong touch and the weak touch (those of the parts (c) and (d) in FIG. 2 and the parts (c) and (d) in FIG. 3) are subjected to spectrum analysis frame by frame and, on the basis of results of this spectrum analysis of the original waveshapes, difference in spectrum between the two waveshapes in the same frame is computed frame by frame. Then a filter characteristics parameter for each frame is computed on the basis of the spectrum difference in the same frame and a filter processing is applied to the original waveshape of the sustain portion corresponding to the strong touch frame by frame in response to this filter characteristics parameter. By virtue of this filter processing, a waveshape resembling the original waveshape of the sustain portion corresponding to the weak touch can be obtained.

After this processing, the original waveshape of the sustain portion corresponding to the strong touch which was the object of the filter processing is stored in the first waveshape memory 121 whereas the waveshape resembling the original waveshape of the sustain portion corresponding to the weak touch which has been obtained by the filter processing is stored in the second waveshape memory 131. Although the waveshape stored in the second waveshape memory 131 resembles the original waveshape of the sustain portion corresponding to the weak touch, it is a waveshape obtained by filtering the original waveshape of the sustain portion corresponding to the strong touch and, accordingly, its phase is not much different from the phase of the original waveshape of the sustain portion corresponding to the strong touch. Thus, phases of the waveshapes to be stored in the waveshape memories 121 and 131 are not different from each other.

The phase adjusted waveshapes of the sustain portion stored in the memories 121 and 131 may be all of the remaining waveshape succeeding the attack portion stored in the same memories 121 and 131 or, alternatively, partial waveshapes of plural periods suitably taken out of the remaining waveshapes. In a case where the entire remaining waveshapes to the end of sounding of the tone is stored in the memories 121 and 131, control is made so that the waveshape data of the attack portion and the sustain portion are read out once in response to the address signal AD generated by the address signal generation circuit 11. In a case where the partial waveshape of the sustain portion of limited periods is stored in the memories 121 and 131, control is made so that the waveshape data of of the attack portion stored in the memories 121 and 131 are read out once and then the waveshape data of the sustain portion stored in the same memories 121 and 131 are repeatedly read out. Since such single or repeated reading out of a series of waveshape data can be performed readily by a known technique, detailed description thereof will be omitted.

In the same manner as in the embodiment of FIG. 1, the original waveshapes having natural amplitude envelopes as shown in FIGS. 2 and 3 may be directly coded in accordance with some coding system such as PCM and the coded waveshape data may be stored in these waveshape memories 121 and 131 or, alternatively, waveshape data whose amplitude level has been standardized to a predetermined level may be stored in these waveshape memories 121 and 131. Depending upon the form of the amplitude envelope, the shape of envelope shape data generated by the envelope generator 25 is suitably selected as shown in FIGS. 4*a*–4*c* in the same manner as was previously described.

Further in the same manner as the embodiment of FIG. 1, the waveshape memories 121 and 131 store the waveshape data of the attack portion and the waveshape data of the sustain portion which have been matched in phase as described above for each tone color kind, enable reading out of waveshapes corresponding to a designated tone color in response to the tone color selection information TC and provide waveshape data of these waveshapes in response to the address signal AD. The function characteristics of the weighting coefficients TK1 and TK2 for the touch strength may differ depending upon the tone color as shown in FIGS. 5*a* and 5*b*.

Figure 12:
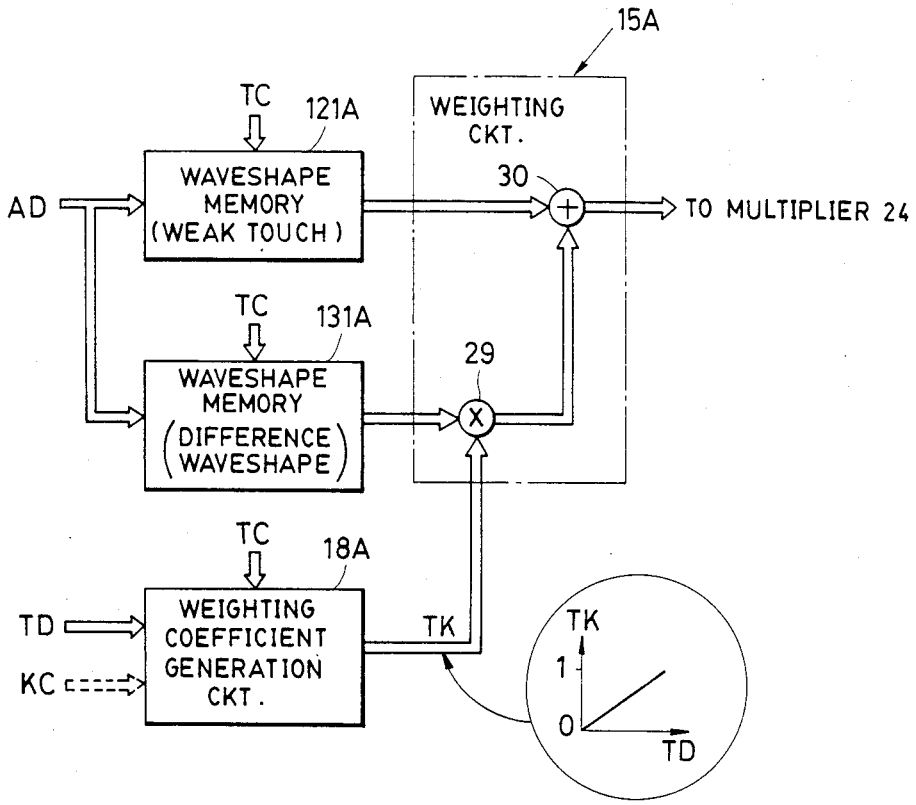
FIG. 12 is a block diagram showing a modified example of the waveshape memory and the weighting circuit shown in FIG. 11.

The same modification as in the examples of FIG. 6 is applicable to the embodiment of FIG. 11. An example of such modification is shown in FIG. 12. In a first waveshape memory 121A, waveshape data of plual periods of the attack portion and the sustain portion of a waveshape corresponding to a weak touch (e.g., a waveshape as shown in FIG. 3) is stored. In a second waveshape memory 131A, waveshape data of a difference waveshape between a waveshape corresponding to a strong touch (e.g., a waveshape as shown in FIG. 2) and the waveshape corresponding to the weak touch stored in the first waveshape memory 121A. More specifically, waveshape data of two channels which are the same as that stored in the above described first and second waveshape memories 121 and 131 (FIG. 11) (i.e., waveshape data of plural periods including the attack portion which is not phase-adjusted and the sustain portion which is phase-adjusted) are prepared after being subjected to phase matching processing as described above and waveshape of one of these channels (e.g., the waveshape data corresponding to the weak touch) is stored in the first waveshape memory 121A. In the meanwhile, waveshape data of a difference waveshape between the waveshape data of the two channels which have been prepared through the phase matching processing is computed and stored in the second waveshape memory 131A.

The weighting circuit 15A and the weighting coefficient generation circuit 18A are of a similar construction to those shown in FIG. 6. Further, the modification shown in FIG. 7 applied to the embodiment of FIG. 6 may be applied also to the embodiment of FIG. 12. That is, an output signal of the waveshape memory 131A may be applied to the weighting circuit 15A after filtering it by a digital filter.

Further, the modification as shown in FIG. 8 applied to the embodiment of FIG. 1 may be applied also to the embodiment of FIG. 11.

In the above described respective embodiments, the functions of weighting coefficients generated by the weighting circuits 18 and 18A and the key scaling coefficient generation circuits 35 and 39 respectively have proper characteristics corresponding to the tone color kind. The invention however is not limited to this but such functions may have characteristics which are common through all kinds of tone colors.

Figure 13:
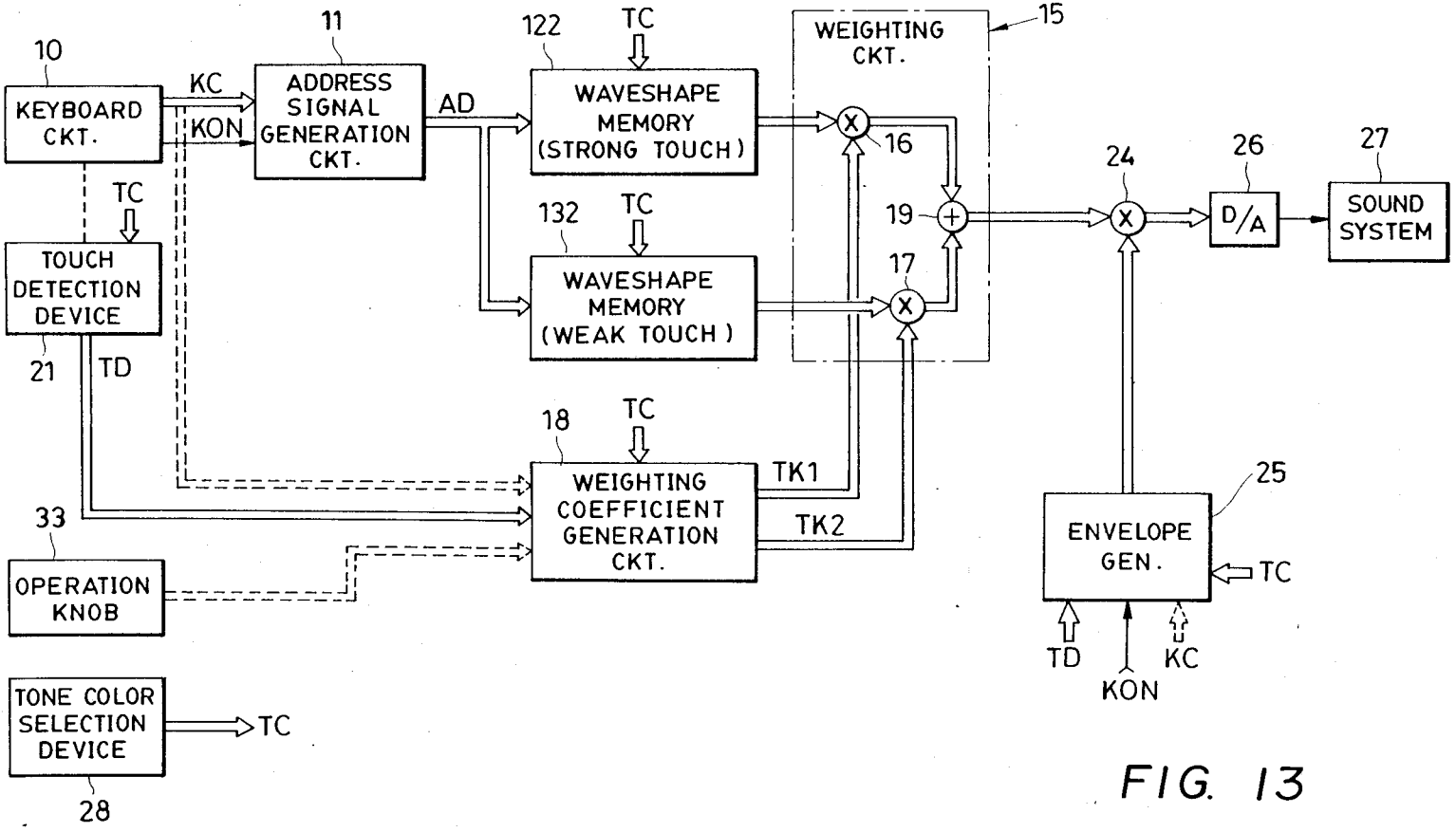
FIG. 13 is a block diagram showing an entire construction of an electronic musical instrument incorporating still aother embodiment of the invention.

In another aspect of the invention, however, it is essential that the function of the weighting coefficient should have proper characteristics corresponding to the tone color kind. In this case, however, the limitations in the embodiments of FIGS. 1 and 11 need not be imposed upon a waveshape to be stored in a waveshape memory. FIG. 13 shows an embodiment of the invention according to this aspect. This embodiment appears the same as the embodiment of FIG. 11 but contents of waveshape data stored in waveshape memories 122 and 132 are not required to have the limitation in those stored in the waveshape memories 121 and 131 of FIG. 11 (i.e., the limitation that the waveshape data of the sustain portion be matched in phase) and yet the function of the weighting coefficient generated by the weighting circuit 18 must have proper characteristics corresponding to the tone color kind as shown in FIGS. 5*a* and 5*b*. The waveshape memories 122 and 132 store waveshape data of plural periods including the attack portion and the sustain portion with respect to both a strong touch and a weak touch. As to the phase relationship between the waveshape data stored in these memories 122 and 132, phase matching may be made in such a manner that, for example, the two waveshapes are in phase to a maximum extent possible in the sustain portion though they need not be in phase in the attack portion. Alternatively, no phase matching may be made for either the attack portion or the sustain portion or phase matching may be made for both of the attack portion and the sustain portion.

The waveshape of the sustain portion stored in the memories 122 and 132 may be all of the remaining waveshape succeeding the attack portion stored in the same memories 122 and 132 or, alternatively, partial waveshape of plural periods suitably taken out of the remaining waveshape or a representative waveshape of one period only. In a case where the entire remaining waveshape to the end of sounding of the tone is stored in the waveshape memories 122 and 132, control is made so that the waveshape data of the attack portion and the sustain portion stored in the memories 122 and 132 are read out once in response to the address signal AD generated by the address signal generation circuit 11. In a case where the partial waveshape of the sustain portion of limited number of periods or one period are stored in the waveshape memories 122 and 132, control is made so that the waveshape data of the attack portion stored in the memories 122 and 132 are read out once in response to the address signal AD and then the waveshape data of the sustain portion are read out repeatedly.

In FIG. 13, for formulating the function of the weighting coefficient as one having proper characteristics corresponding to the tone color kind, the weighting coefficient generation circuit 18 may be constructed of a memory storing weighting coefficient functions corresponding to the respective tone colors or may be constructed of an operation circuit which computes a weighting function characteristics formula corresponding to a select tone color using the touch detection data TD as a variable or may be constructed of a combination of such memory and operation circuit.

In the above described respective embodiments, description has been made with respect to a case where a tone signal of a scale note is generated by designating the tone pitch of the tone to be generated by a keyboard. The tone signal generation device according to the invention is applicable also to a rhythm tone source. In this case, the weighting control data may be generated in response to data which simulates the strength of playing a rhythm musical instrument (e.g., data based on operation of an operation knob or data contained in rhythm pattern data or data applied from outside).

The above embodiments have been described with respect to a monophonic instrument but the invention is applicable also to a polyphonic musical instrument. In this case, some circuits such as the waveshape memories and the weighting circuit may be shared commonly by plural tone generation channels on a time shared basis.

In the above described embodiments, waveshape memories of two channels are provided with respect to one tone color control factor for weighting computation. The invention is not limited to this but the device may comprise three or more channels. In this case, waveshapes of three or more channels may be weighted simultaneously or waveshapes of two channels may be selectively weighted.

In the above embodiments, description has been made about a construction in which a waveshape memory storing a waveshape corresponding to a predetermined tone color control state such as a strong touch or a weak touch and a waveshape memory storing a waveshape of the sustain portion are composed of separate memories in terms of hardware construction. These memories may be a memory device which is a single memory used commonly for these functions in terms of hardware construction. In FIG. 1, for example, waveshape data of the attack portion corresponding to a strong touch for a certain tone color may be stored in a memory area of addresses A through B, waveshape data of the attack portion corresponding to a weak touch in a memory area of addresses B+1 through C, and common waveshape data of the sustain portion in a memory area of addresses C+1 through D (A, B, C and D being predetermined address values satisfying the relation A<B<C<D). In FIG. 11, for example, waveshape data of the attack portion corresponding to a strong touch for a certain tone color may be stored in a memory area of addresses A through B, waveshape data of the attack portion corresponding to a weal touch in a memory area of addresses B+1 through C, waveshape data of the sustain portion corresponding to a strong touch in a memory area of addresses C+1 through D and waveshape data of the sustain portion corresponding to a weak touch in a memory area of addresses D+1 through E (A, B, C, D and E being predetermined address values satisfying the relation A<B<C<D<E). In this case, reading out of the respective waveshape data from the respective memory areas is controlled on a time shared basis.

In FIGS. 1, 11 and 13, a digital filter may be provided in a post stage to the selector 20 or the weighting circuit 15 so as to impart further tone color change in accordance with the tone color control factors such as the key touch and key scaling.

The coding system employed for coding waveshape data to be stored in the waveshape memories is not limited to the PCM system as described above but other suitable waveshape coding system such as the difference PCM system, adapted difference PCM system, delta modulation system (DM) and adapted delta modulation system (ADM) may be employed. In this case, a demodulation circuit which is matching to the employed coding system may be provided in a post stage to the waveshape memories so that the coding system of the waveshape data read out from the memories will be restored (demodulated) to the PCM system.

Instead of electrically adding and combining the weighted waveshape signals of respective channels by an adder, these signals may be directly sounded as signals of separate channels and added and combined in the sound field. Further, in FIG. 1, instead of connecting the sustain waveshape signal to the attack waveshape signal by using the selector 20 or the adder 48 in the crossfading circuit 41, these signals may be sounded directly in the separate channels and connected in the sound field.

In FIG. 1, the waveshapes of plural periods of the attack portion for the respective channels to be stored in the waveshape memories are preferably substantially matched in phase but it is not essential that these waveshapes be matched in phase.

The waveshapes of plural periods to be stored in the waveshape memories need not necessarily be waveshapes of continuous plural periods but they may be waveshapes consisting of periods which have been skippingly taken out. For example, an arrangement may be made so that the tone waveshape from the start of sounding to the end thereof is divided into plural frames, waveshape data of a representative waveshape consisting of one period or two periods for each frame is stored and this waveshape data is repeatedly read out while the waveshape data is switched from one frame to another after the repeated reading of one waveshape data. If necessary, an interpolation operation may be made between a preceding waveshape and a succeeding waveshape at the time of switching of the waveshape data so as to form smoothly changing waveshape data.

In FIG. 1, the device for generating the waveshape signal of the sustain portion is not limited to the waveshape memory used in the above described embodiment but other tone waveshape generation means such as a harmonics combining system and a tone waveshape combining system using a frequency modulation operation may also be utilized.

What is claimed is:

1. A tone signal generation device comprising:

attack memory means for storing plural attack data respectively constituting plural attack waveshapes relating to an attack portion of tone waveshape representing a tone signal to be generated, said attack waveshapes being different in shape from each other;

readout means for reading out at least two among said plural attack data from said attack memory means;

weighting data generation means for generating weighting data;

weighting means for weighting the read out attack data in accordance with said weighting data and for generating a new attack waveshape on the basis of the weighted attack data;

sustain waveshape generation means for generating a sustain waveshape corresponding to a sustain portion of said tone waveshape following generation of said new attack waveshape; and means for combining the new attack waveshape and the sustain waveshape to form a waveshape signal including an attack portion and a sustain portion.

2. A tone signal generation device as defined in claim 1 which further comprises keys designating tone pitch of a tone to be generated and wherein said weighting data generation means generates said weighting data whose value corresponds to strength or speed of touch of a depressed key among said keys.

3. A tone signal generation device as defined in claim 1 wherein said weighting data generation means generates said weighting data whose value corresponds to tone pitch or tone range of said tone signal to be generated.

4. A tone signal generation device as defined in claim 1 which further comprises an operation knob used for controlling a tone color characterizing said tone signal and wherein said weighting data generation means generates said weighting data those value corresponds to an operation state or amount of said operation knob.

5. A tone signal generation device as defined in claim 1 wherein said tone signal is one of a rhythm sound and said weighting data differ depending upon data which simulates strength of playing a rhythm musical instrument producing the rhythm sound.

6. A tone signal generation device as defined in claim 1 wherein the means for combining operates such that said sustain waveshape is connected to the end of said new attack waveshape so that generation of said sustain waveshape is started upon completion of generation of said new attack waveshape.

7. A tone signal generation device as defined in claim 1 wherein the means for combining operates such that said sustain waveshape is connected to the end of said new attack waveshape by generating a predetermined end section of said new attack waveshape and a predetermined start section of said sustain waveshape in a timewise overlapping fashion so as to weight the attack waveshape with decay characteristics and the sustain waveshape with attack characteristics.

8. A tone signal generation device as defined in claim 1 which further comprises tone color selection means for selecting a tone color characterizing a tone signal to be generated and wherein said weighting data generation means generates said weighting data whose value corresponds to the selected tone color.

9. A tone signal generation device comprising:

attack memory means for storing plural attack data respectively constituting plural attack waveshapes relating to an attack portion of tone waveshape representing a tone signal to be generated, one of said plural attack data being reference data representing a specified one of plural attack waveshapes of tones to be sounded and another one of said plural attack data representing the difference between said specified one and another one of said plural attack waveshapes;

readout means for reading out of the reference and difference data from said waveshape memory means;

weighting data generation means for generating weighting data;

weighting means for weighting said read out difference data in accordance with said weighting data;

combining means for combining the weighted difference data and the read out reference data and for providing a new attack waveshape on the basis of the combined result;

sustain waveshape generation means for generating a sustain waveshape signal corresponding to a sustain portion of said tone waveshape following generation of said new attack waveshape; and means for forming a waveshape including an attack portion and a sustain portion on the basis of the new attack waveshape and the sustain waveshape.

10. A tone signal generation device as defined in claim 9 wherein said combining means includes suppressing means for suppressing harmonic content included in the waveshape corresponding to said weighted difference data.

11. A tone signal generation device as defined in claim 9 which further comprises tone color selection means for selecting a tone color characterizing a tone signal to be generated and wherein said weighting data generation means generates said weighting data whose value corresponds to the selected tone color.

12. A tone signal generation device comprising:

waveshape memeory means for storing plural waveshape data respectively constituting plural waveshapes each of which comprises an attack portion and a sustain portion, the sustain portions of said plural waveshapes being stored in the phase-adjusted state so that said sustain portions become substantially in phase with each other;

readout means for reading out at least two of said waveshape data from said waveshape memory means;

weighting data generation means for generating weighting data; and weighting means for weighting the read out waveshape data in accordance with the weighting data, and (b) thereafter combining the weighted waveshape data and providing the combined data as a tone signal.

13. A tone signal generation device as defined in claim 12 which further comprises keys designating tone pitch of a tone to be generated and wherein said weighting data generation means generates said weighting data whose value corresponds to strength or speed of touch of a depressed key among said keys.

14. A tone signal generation device as defined in claim 12 wherein said weighting data generation means generates said weighting data whose value corresponds to tone pitch or tone range of said tone signal to be generated.

15. A tone signal generation device as defined in claim 12 which further comprises an operation knob used for controlling a tone color characterizing said tone signal and wherein said weighting data generation means generates said weighting data whose value corresponds to an operation state or amount of said operation knob.

16. A tone signal generation device as defined in claim 12 wherein said tone signal is one of a rhythm sound and said weighting data differs depending upon data which simulates strength of playing a rhythm musical instrument producing the rhythm sound.

17. A tone signal generation device as defined in claim 12 which further comprises tone color selection means for selecting a tone color characterizing a tone signal to be generated and wherein said weighting data generation means generates said weighting data whose value corresponds to the selected tone color.

18. A tone signal generation device comprising:

waveshape memory means for storing first waveshape data representing a first waveshape and second waveshape data constituting a second waveshape, said first and second waveshapes respectively including attack portions of said first and second waveshapes which are not adjusted in phase and sustain portions of said first and second waveshapes which have been adjusted to be substantially in phase, wherein said first waveshape is a waveshape of a first tone and said second waveshape data represents a difference between said first waveshape and the waveshape of a second tone;

readout means for reading out said first and second waveshape data from said waveshape memory means;

weighting data generation means for generating weighting data;

weighting means for weighting the read out second waveshape data in accordance with the weighting data; and combining means for combining the weighted second waveshape data and the read out first waveshape data together and for providing the combined signal as a tone signal.

19. A tone signal generation device as defined in claim 18 wherein said combining means includes suppressing means for suppressing harmonic content included in the waveshape signal corresponding to said weighted second waveshape data.

20. A tone signal generation device as defined in claim 18 which further comprises tone color selection means for selecting a tone color characterizing a tone signal to be generated and wherein said weighting data generation means generates said weighting data whose value corresponds to the selected tone color.

* * * * *